US010138771B2

(12) United States Patent
Ariyama et al.

(10) Patent No.: US 10,138,771 B2
(45) Date of Patent: Nov. 27, 2018

(54) OIL BYPASS STRUCTURE OF OIL COOLER

(71) Applicant: MAHLE FILTER SYSTEMS JAPAN CORPORATION, Tokyo (JP)

(72) Inventors: Masahiro Ariyama, Yokohama (JP); Katsuhiro Isoda, Sayama (JP); Kenji Yamashita, Higashimurayama (JP)

(73) Assignee: MAHLE FILTER SYSTEMS JAPAN CORPORATION, Tokyo (JP)

( * ) Notice: Subject to any disclaimer, the term of this patent is extended or adjusted under 35 U.S.C. 154(b) by 53 days.

(21) Appl. No.: 15/340,203

(22) Filed: Nov. 1, 2016

(65) Prior Publication Data

US 2017/0175599 A1 Jun. 22, 2017

(30) Foreign Application Priority Data

Dec. 22, 2015 (JP) ..... 2015-249483

(51) Int. Cl.

| | |
|---|---|
| ***F01M 5/00*** | (2006.01) |
| ***F01P 11/08*** | (2006.01) |
| ***F28F 3/02*** | (2006.01) |
| ***F28F 27/02*** | (2006.01) |

(Continued)

(52) U.S. Cl.

CPC ..... *F01M 5/002* (2013.01); *F01M 5/005* (2013.01); *F01P 11/08* (2013.01); *F28D 9/005* (2013.01); *F28F 3/027* (2013.01); *F28F 27/02* (2013.01); *F28D 2021/0089* (2013.01); *F28F 2250/06* (2013.01)

(58) Field of Classification Search

CPC ..... F01M 5/002; F01M 5/005; F28D 9/005; F28D 2021/0089; F28F 3/027; F28F 27/02; F28F 2250/06; F01P 11/08

See application file for complete search history.

(56) References Cited

U.S. PATENT DOCUMENTS 3,743,011 A * 7/1973 Frost ..... F01M 1/10 165/283
2006/0076129 A1* 4/2006 Eliades ..... F28F 27/02 165/297

(Continued)

FOREIGN PATENT DOCUMENTS

| | | |
|---|---|---|
| DE | 10 2007 052 706 A1 | 5/2009 |
| FR | 2 853 725 A1 | 10/2004 |
| JP | 5-96766 U | 12/1993 |

OTHER PUBLICATIONS

Extended European Search Report, dated May 19, 2017, 7 pages.

*Primary Examiner* — Jacob Amick
*Assistant Examiner* — Charles Brauch
(74) *Attorney, Agent, or Firm* — Foley & Lardner LLP

(57) ABSTRACT

An oil bypass structure of an oil cooler includes: a bypass passage; an outlet side passage; and bypass valve disposed at a connection portion between the bypass passage and the outlet side passage, the bypass valve which includes a valve element including an inside passage, and within which the oil flows, the bypass valve being arranged to be closed to shut off a flow of the oil from the bypass passage to the outlet side passage by the valve element so that the oil passing through the heat exchange section flows within the inside passage, and to be opened to connect the bypass passage and the inside passage so that the oil passing through the bypass passage flows within the inside passage.

4 Claims, 9 Drawing Sheets

(51) Int. Cl.
*F28D 9/00* (2006.01)
*F28D 21/00* (2006.01)

(56) References Cited

U.S. PATENT DOCUMENTS

| | | | |
|---|---|---|---|
| 2010/0206516 | A1 | 8/2010 | Müller-Lufft et al. |
| 2013/0160972 | A1 | 6/2013 | Sheppard et al. |

* cited by examiner

OIL BYPASS STRUCTURE OF OIL COOLER

BACKGROUND OF THE INVENTION

This invention relates to an oil bypass structure of an oil cooler.

A utility model application publication No. H5-96766 discloses an oil cooler arranged to open a bypass valve disposed at a connection portion between an oil introduction passage and a bypass passage when an internal pressure of an oil within a casing is increased due to a clogging and so on so as to connect the oil introduction passage and the bypass passage so that the oil bypasses a core within the casing to be introduced into an oil flow outlet.

SUMMARY OF THE INVENTION

However, in the above-described patent document, the only oil passing through the oil introduction passage provided on an upstream side of the bypass valve flows within the bypass passage provided on a downstream side of the bypass valve.

That is, in the bypass passage in the above-described patent document, the oil does not constantly flow within the bypass passage. The bypass passage does not serve when the bypass valve is closed. That is, in the conventional oil bypass structure of the oil cooler described in the above-described patent document, it is necessary to provide a bypass passage within which the only oil passing through the oil introduction passage flows. Accordingly, the system is complicated. Therefore, there is a room for improving a structure of the bypass valve and the passages on the downstream side of the bypass valve.

It is an object of the present invention to provide an oil bypass structure of oil cooler to devised to solve the above mentioned problem, and to simplify the oil bypass structure.

According to one aspect of the present invention, an oil bypass structure of an oil cooler comprises: a bypass passage within which an oil bypassing a heat exchange section of the oil cooler flows; an outlet side passage within which the oil passing through the heat exchange section flows; and a bypass valve disposed at a connection portion between the bypass passage and the outlet side passage, the bypass valve which includes a valve element including an inside passage which is formed within the valve element, and within which the oil flows, the bypass valve to which the bypass passage is connected from a direction perpendicular to an axial direction of the valve element, the bypass valve being arranged to be closed to shut off a flow of the oil from the bypass passage to the outlet side passage by the valve element so that the oil passing through the heat exchange section flows within the inside passage, and to be opened to connect the bypass passage and the inside passage so that the oil passing through the bypass passage flows within the inside passage.

DETAILED DESCRIPTION OF THE INVENTION

Figure 1:
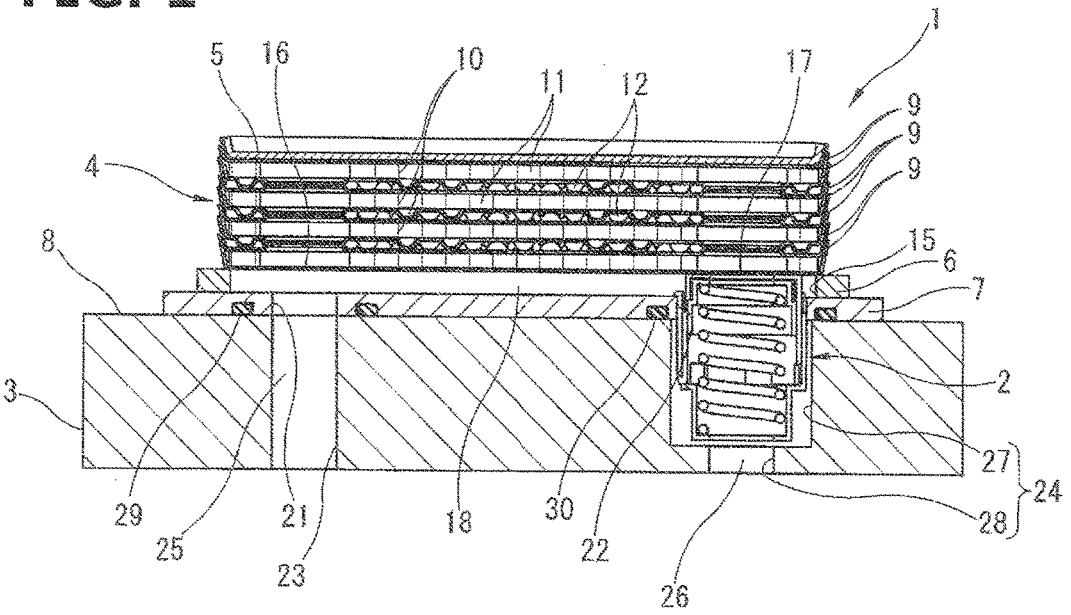
FIG. 1 is a sectional view which is for illustrating an oil bypass structure of an oil cooler according to a first embodiment of the present invention, and which shows main parts in a valve closing state of a bypass valve.
Figure 2:
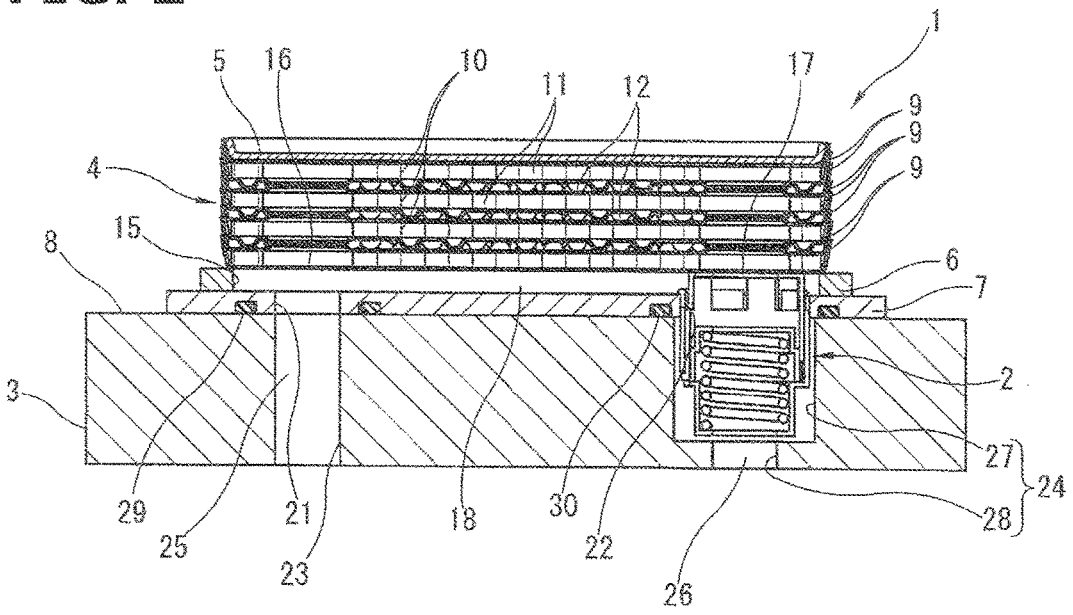
FIG. 2 is a sectional view which is for illustrating the oil bypass structure of the oil cooler according to the first embodiment of the present invention, and which shows the main parts in a valve opening state of the bypass valve.

Hereinafter, embodiments according to the present invention are explained in detail with reference to the drawings. FIGS. 1 and 2 schematically show an oil bypass structure of an oil cooler in a first embodiment according to the present invention. FIG. 1 is a sectional view showing main parts when a bypass valve 2 is closed. FIG. 2 is a sectional view showing the main parts when the bypass valve 2 is opened. Besides, in below-described explanations, terms such as "upper (upward)", "lower (downward)", "top portion", "bottom portion" and so on are used for the explanations with reference to a posture in FIGS. 1 and 2. However, the mounting posture at the actual use of the oil cooler 1 is not limited to the mounting posture in FIGS. 1 and 2. Moreover, a hatching is omitted in sections of some of members for the explanations.

This oil cooler 1 is arranged to cool an engine oil of a vehicle by a heat exchange with a coolant. This oil cooler 1 is directly mounted to a cylinder block 3 of an internal combustion engine which is a block.

The oil cooler 1 includes a heat exchange section 4 arranged to perform a heat exchange between the oil and the coolant; a top plate 5 which has a relatively large thickness, and which is mounted on an upper surface of the heat exchange section 4; a first bottom plate 6 which is mounted on a lowermost surface of the heat exchange section 4; a second bottom plate 7 which has a relatively large thickness, which is mounted on a lower surface of the first bottom plate 6, and which is fixed on an oil cooler mounting surface 8 of the cylinder block 3 by bolts (not shown), and so on.

The heat exchange section 4 includes core plates 9 each of which has a shallow rectangular dish shape, and each of which has an identical shape; and fin plates 10. The plurality of core plates 9 and the plurality of fin plates 10 are stacked with each other. With this, oil flow passages 11 and coolant flow passages 12 are alternately formed between adjacent two of the core plates 9. Besides, the core plates 9 include core plates 9 which are a plurality of types, and which have shapes varied in detail. These core plates 9 are appropriately combined.

The plurality of core plates 9, the plurality of fin plates 10, the top plate 5, and the first and second bottom plates 6 and 7 are joined with each other by brazing (soldering) to be formed into an integral member. In particular, these components are formed from a clad material formed by covering a brazing material layer on a surface of a base material of an aluminum alloy. Portions of the components are temporally assembled at predetermined positions. This is heated within a furnace, so that these are joined by the brazing (soldering).

Figure 3:
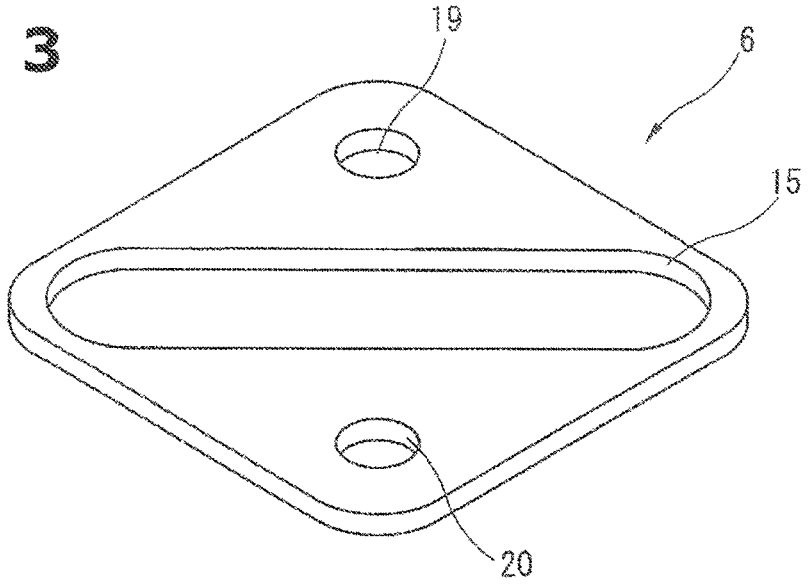
FIG. 3 is a perspective view showing a first bottom plate of the oil cooler according to the first embodiment.
Figure 4:
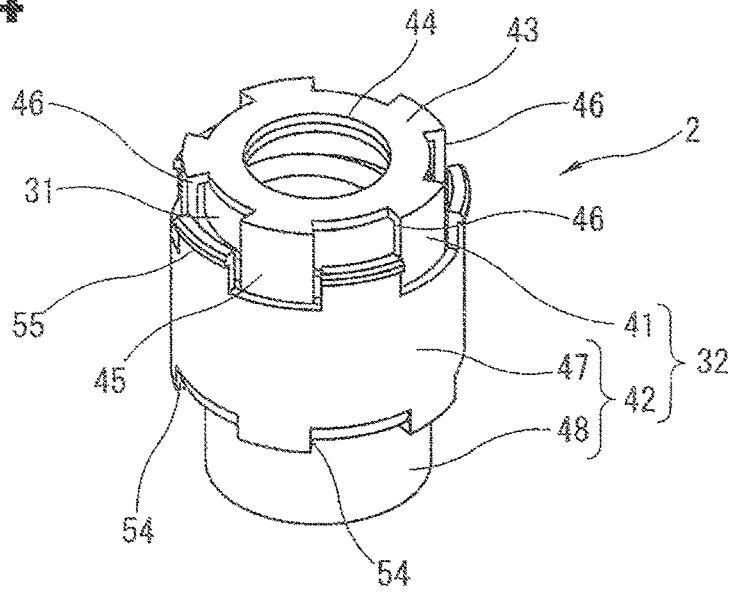
FIG. 4 is a perspective view showing the bypass valve according to the first embodiment.
Figure 5:
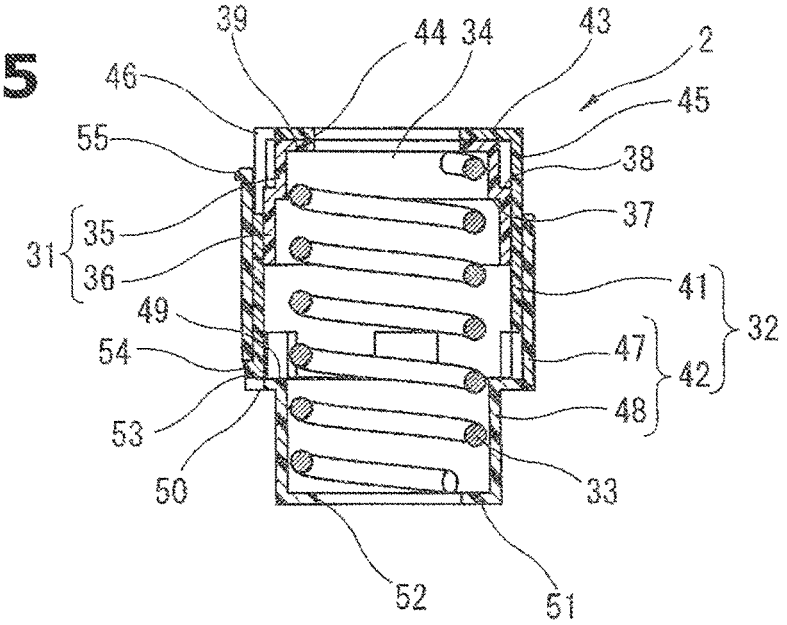
FIG. 5 is a sectional view showing the bypass valve according to the first embodiment.
Figure 6:
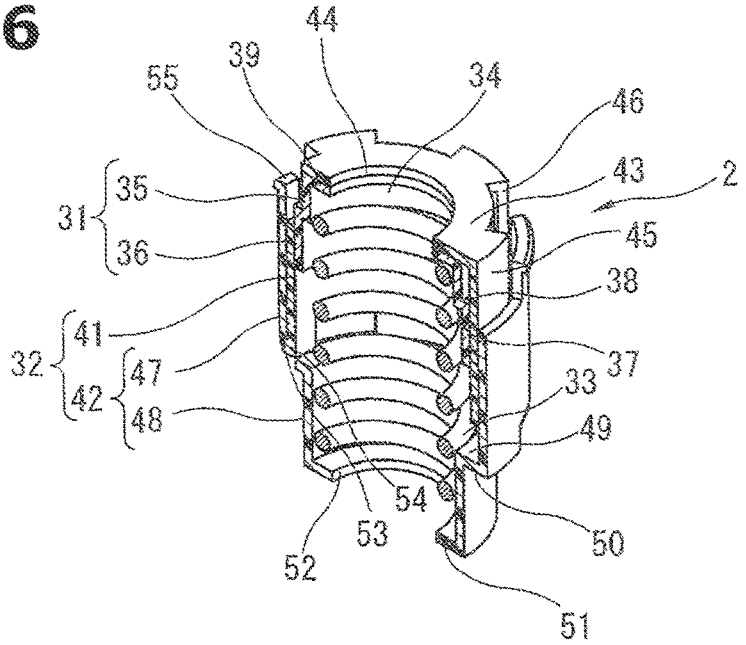
FIG. 6 is an explanation view showing the bypass valve in which a portion of the bypass valve is cutaway in the first embodiment.

The first bottom plate 6 is positioned between the lowermost surface of the heat exchange section 4 and the second bottom plate 7. As shown in FIG. 3, the first bottom plate 6 includes a first through hole 15 which has an elongated shape extending along a diagonal line of the first bottom plate 6. This first through hole 15 includes a first end side connected to an oil introduction hole 16 formed on a lowermost surface of the heat exchange section 4, and a second end side connected to an oil discharge opening 17 formed on the lowermost surface of the heat exchange section 4. This first through hole 15 constitutes a bypass passage 18 with the lowermost surface of the heat exchange section 4 and the upper surface of the second bottom plate 7. The oil which bypasses the heat exchange section 4 flows through the bypass passage 18. This bypass passage 18 extends in parallel with the oil cooler mounting surface 8 of the cylinder block 3 to which the oil cooler 1 is mounted.

Furthermore, the first bottom plate 6 includes a first coolant inlet side through hole 19 through which the coolant introduced into the coolant flow passage 12 within the heat exchange section 4 flows; and a first coolant outlet side through hole 20 through which the coolant discharged from the coolant flow passage 12 within the heat exchange section 4 flows.

The second bottom plate 7 includes a second oil inlet side through hole 21 which has a circular section, and through which the oil introduced into the oil flow passage 11 within the heat exchanger 4 flows; and a second oil outlet side through hole 22 which has a circular section, and through which the oil discharged from the oil flow passage 11 within the heat exchanger section 4 flows. The second oil inlet side through hole 21 includes a lower end connected to a block side oil introduction passage 23 formed in the cylinder block 3; and an upper end connected to the first end side of the first through hole 15 formed in the first bottom plate 6. The second oil outlet side through hole 22 includes a lower end connected to a block side oil discharge passage 24 formed in the cylinder block 3; and an upper end connected to the second end side of the first through hole 15 formed in the first bottom plate 6.

Moreover, this second bottom plate 7 includes a second coolant inlet side through hole (not shown) through which the coolant introduced into the coolant flow passage 12 within the heat exchanger section 4 flows; and a second coolant outlet side through hole (not shown) through which the coolant discharged from the coolant flow passage 12 within the heat exchange section 4 flows. The second coolant inlet side through hole includes a lower end connected to the block side coolant introduction passage (not shown) formed in the cylinder block 3; and an upper end connected to the first coolant inlet side through hole 19 formed in the first bottom plate 6. The second coolant inlet side through hole includes a lower end connected to the block side coolant discharge passage (not shown) formed in the cylinder block 3; and an upper end connected to the first coolant outlet side through hole 20 formed in the first bottom plate 6.

The oil is introduced into the oil introduction opening 16 of the heat exchanger section 4 through the inlet side passage 25 constituted by the block side oil introduction passage 23, the second oil inlet side through hole 21, and a portion on the first end side of the first through hole 15, and so on. Moreover, the oil is discharged from the oil discharge opening 17 of the heat exchanger section 4 through an outlet side passage 26 constituted by a portion on the second end side of the first through hole 15, the second oil outlet side through hole 22, the block side oil discharge passage 24, and so on.

The block side oil discharge passage 24 formed in the cylinder block 3 includes an upstream side hole portion 27 which has a circular section, and which is positioned on the oil cooler mounting surface 8's side; and a downstream side hole portion 28 which has a circular section, and which is connected to this upstream side hole portion 27.

The upstream side hole portion 27 includes an inside diameter which is larger than an outside diameter of the lower end side of the bypass valve 2. The upstream side hole portion 27 has a center axis which is perpendicular to the oil cooler mounting surface 8. The downstream side hole portion 28 has an inside diameter which is smaller than an inside diameter of the upstream side hole portion 27.

Besides, a symbol 29 in FIG. 1 and FIG. 2 is a seal member arranged to seal a circumference of the second oil inlet side through hole 21 on the oil cooler mounting surface 8. A symbol 30 in FIG. 1 and FIG. 2 is a seal member arranged to seal a circumference of the second oil outlet side through hole 22 on the oil cooler mounting surface 8. Furthermore, the first through hole 15 has a width which is larger than diameters of the oil introduction hole 16, the oil discharge hole 17, the second oil inlet side through hole 21, and the second oil outlet side through hole 22. Accordingly, in the assembly state, the oil introduction opening 16, the oil discharge opening 17, the second oil inlet side through hole 21, and the second oil outlet side through hole 22 are positioned inside the first through hole 15.

A bypass valve 2 is disposed in the outlet side passage 26. As shown in FIG. 1, FIG. 2, and FIG. 4 to FIG. 6, the bypass valve 2 includes a valve element 31 which has a stepped cylindrical shape; a casing 32 within which the valve element 31 is received; and a coil spring 33 which is received within the casing 32, and which is a spring member arranged to constantly urge the valve element 31 in a valve closing direction (in the upward direction in FIG. 1 and FIG. 2).

For example, the valve element 31 is made from a synthetic resin material. The valve element 31 includes an inside passage 34 which is formed within the valve element 31, and through which the oil flows in an axial direction of the valve element 31 (in the upward and downward directions of FIG. 1 and FIG. 2). This valve element 31 includes an upper end portion 35 which has a relatively small diameter; a lower end portion 36 which has a relatively large diameter; a valve element inner circumference side stepped surface 37 which are continuously formed around the entire circumference, on the inner circumference of the continuous portion at which the upper end portion 35 and the lower end portion 36 are connected; and a valve element outer circumference side stepped surface 38 which are continuously formed around the entire circumference, on the outer circumference of the continuous portion at which the upper end portion 35 and the lower end portion 36 are connected. The valve element outer circumference side stepped surface 38 is a pressure receiving surface arranged to receive a force in the valve opening direction (in the downward direction of FIG. 1 and FIG. 2) from the oil within the bypass passage 18.

In this case, the valve closing direction and the valve opening direction of the valve element 31 correspond to the axial direction of the valve element 31.

The valve element 31 includes an annular protruding wall 39 which is formed continuously around the entire circumference surface on the inner circumference of the upper end of the upper end portion 35. An inner circumference side of this protruding wall 39 serves as an opening of the valve element 31 on the upper end side. That is, the valve element 31 is formed into a stepped bottomed cylindrical shape. Moreover, the valve element 31 includes a through hole formed in the bottom wall positioned on the upper end side.

The valve element inner circumference side stepped surface 37 and the inside surface of the protruding wall 39 serve as pressure receiving surfaces which receive the force from the oil within the inside passage 34 in the valve closing direction of the valve element 31.

The casing 32 is made from the resin material. The casing 32 includes an upper portion casing 41 which has a bottomed cylindrical shape receiving the valve element 31; and a lower portion casing 42 which has a stepped bottomed cylindrical shape.

The upper casing 41 includes an upper end discharge opening 44 which is a through hole having a circular section, which is formed at a central of the bottom wall 43 on the upper end side to which the upper end of the valve element 31 is pressed, and which connects the oil discharge opening 17 and the inside passage 34 of the valve element 31. Moreover, the upper casing 41 includes a plurality of side opening portions 46 which are a plurality of through holes that extending in a circumferential direction, and which are formed on the upper end side of the side wall 45. The pressure of the oil within the bypass passage 18 is acted from this side opening portions 46 to the valve element outer circumference side stepped surface 38 of the valve element 31.

The upper casing 41 has an inside diameter which is set so that the lower end portion 36 of the valve element 31 is slidable (within the upper casing 41). That is, the inside diameter of the upper casing 41 is set so that there is a predetermined clearance between the upper casing 41 and the lower end portion 36 of the valve element 31.

The lower casing 42 includes a large diameter portion 47 which has a relatively large diameter, and which is located on the upper end side; a small diameter portion 48 which has a relatively small diameter, and which is located on the lower end side; a casing inner circumference side stepped surface 49 which is formed all around the inner circumference of the continuous portion at which the large diameter portion 47 and the small diameter portion 48 are continued; and a casing outer circumference side stepped surface 50 which is formed all around the outer circumference of the continuous portion at which the large diameter portion 47 and the small diameter portion 48 are continued.

In the lower portion casing 42, the small diameter portion 48 includes a bottom wall 51. This bottom wall 51 includes a lower end opening portion 52 which has a circular section, and which is formed at a central of the bottom wall 51. Moreover, the small diameter portion 48 of the lower portion casing 42 has an inside diameter set to be smaller than the inside diameter of the lower end portion 36 of the valve element 31.

The lower end side of the upper portion casing 41 is inserted into the large diameter portion 47 of the lower portion casing 42. The protrusion 53 of the outer circumference of the lower end of the upper portion casing 41 is engaged with the opening 54 of the large diameter portion 47 of the lower portion casing 42, so that the upper casing 41 and the lower casing 42 are fixed with each other. That is, the upper casing 41 and the lower casing 42 are connected by the snap fit.

The coil spring 33 is made from the metal material. The coil spring 33 is positioned on the inner circumference side of the valve element 31 and the casing 32. The coil spring 33 is disposed within the inside passage 34 of the valve element 31. The coil spring 33 is sandwiched between the protruding wall 39 of the valve element 31 and the bottom wall 51 of the lower casing 42 on the lower end side.

This bypass valve 2 includes the upper end side inserted from the second oil outlet side through hole 22 of the second bottom plate 7 into the oil cooler 1. The protrusion 55 of the outer circumference side of the upper end of the large diameter portion 47 of the lower casing 42 is engaged with the upper opening edge of the second oil outlet side through hole 22 in a state where the bottom wall 43 of the upper end of the upper casing 41 is closely abutted on the lowermost surface of the heat exchange section 4, so that the bypass valve 2 is fixed to the oil cooler 1. That is, the bypass valve 2 is fixed to the oil cooler 1 by the snap fit.

In this case, the oil discharge opening 17 and the upper end opening portion 44 are overlapped with each other. Moreover, the upper end side of the bypass valve 2 is disposed within the bypass passage 18. That is, the bypass valve 3 is disposed at the connection portion between the outlet side passage 26 and the bypass passage 18. Furthermore, the bypass passage 18 is connected to the bypass valve 2 from the direct perpendicular to the axial direction of the valve element 31. That is, the bypass passage 18 is connected to the bypass valve 2 from the direction perpendicular to the forward and rearward directions (movement direction) of the valve element 31.

The lower end side of the bypass valve 2 is received within the upstream hole portion 27 of the block side oil discharge passage 24 when the oil cooler 1 is assembled to the cylinder block 3. In this case, the upstream hole portion 27 may be a size which can receive the lower end side of the bypass valve 2. It is not necessary to strictly adjust the clearance between the upstream hole portion 27 and the outside diameter of the bypass valve 2. Accordingly, it is possible to easily form the upstream hole portion 27 in the cylinder block 3.

In a case where there is a clogging (plugging) in the oil flow passage 11 within the heat exchange section 4, the pressure difference between the pressure of the oil flowing within the inside passage 34 of the valve element 31, and the pressure of the oil of the bypass passage 18 connected to the inlet side passage 25 becomes small. That is, the pressure difference between the pressure of the oil within the bypass passage 18 which acts on the valve element outer circumference side stepped surface 38 to urge the valve element 31 in the valve opening direction, and the pressure of the oil within the inside passage 34 which acts the valve element inner circumference side stepped surface 37 and the inside surface of the protruding wall 39 to urge the valve element 31 in the valve closing direction becomes small.

Accordingly, in a case where the pressure of the oil flowing within the inside passage 34 of the valve element 31 is not relatively decreased, the bypass valve 2 is pressed on the bottom wall 43 of the upper casing 41 in the valve closing direction by the urging force of the coil spring 33, as shown in FIG. 1, so that the oil does not flow from the bypass passage 18 to the outlet side passage 26. That is, in the valve closing state of the bypass valve 2, the flow of the oil from the bypass passage 18 to the outlet side passage 26 is shut off by the valve element 31. The inside passage 34 is directly connected with the oil discharge opening 17 of the heat exchange section 4. Consequently, the oil flowing within the inlet side passage 25 necessarily flows through the heat exchange section 4 into the outlet side passage 26. The oil is cooled in accordance with the performance of the heat exchange section 4.

In a case where the pressure loss is increased due to the generation of the clogging of the oil flow passage 11 within the heat exchange section 4, and so on, the pressure of the oil flowing within the inside passage 34 of the valve element 31 is relatively decreased. That is, the pressure of the oil within the bypass passage 18 which acts the valve element outer circumference side stepped surface 38 to urge the valve element 31 in the valve opening direction becomes larger than the pressure of the oil within the inside passage 38 which acts on the valve element inner circumference side stepped surface 37 and the inner surface of the protruding wall 39 to urge the valve element 31 in the valve closing direction.

Therefore, when the pressure of the oil within the bypass passage 18 which is acted on the valve element outer circumference side stepped surface 38 is greater than the urging force of the coil spring 33, the valve element 31 is slid in the valve opening direction, as shown in FIG. 2, so that the inside passage 34 of the valve element 31 and the bypass passage 18 are connected with each other. Then, the oil of the inlet side passage 25 flows into the bypass passage 18. With this, the oil can bypass the heat exchange section 4, and can flow into the outlet side passage 26. Consequently, it is possible to avoid the extreme increase of the pressure of the oil of the inlet side passage 25.

Besides, the sliding movement of the valve element 31 in the valve opening direction is restricted by the lower end of the lower end portion 36 of the valve element 31 abutting on the casing inner circumference side stepped surface 49. Moreover, the oil constantly flows within the inside passage 34 of the valve element 31, irrespective of the opening and closing states of the bypass valve 2. Accordingly, the inside passage 34 of the valve element 31 substantially serves as a part of the outlet side passage 26.

In thus-constructed oil bypass structure according to the first embodiment, the oil introduced through the bypass passage 18 into the outlet side passage 26, and the oil introduced through the heat exchange section 4 into the outlet side passage 26 without passing through the bypass passage 18 flow within the inside passage 34 of the valve element 31. Accordingly, it is possible to suppress the size increase of the system, and to omit the oil passage which is located on the downstream side of the bypass valve 2, and within which the only oil passing through the bypass passage 18 flows. Consequently, it is possible to relatively simplify the oil bypass structure of the oil cooler 1, and to attain the cost reduction. Furthermore, it is possible to improve the freedom of the layout.

In a state where the bypass valve 2 and the oil cooler 1 is integrated, it can be assembled to the cylinder block. Accordingly, it is possible to improve the assembling characteristics relative to a case where the bypass valve 2 and the oil cooler 1 are independently assembled to the cylinder block 3.

The bypass passage 18 is formed within the oil cooler 1. Consequently, it is possible to simplify the assembling process of the cylinder block 3, relative to a case where the bypass passage 18 is formed in the cylinder block. Furthermore, it is possible to attain the cost reduction.

Moreover, in the bypass valve 2, the clearance between the valve element 31 and the upper casing 41 may be set to the large size, so as to use the bypass passage 18 even when the valve element 31 is closed (the valve element 31 is pressed on the bottom wall 43 of the upper casing 41). With this, it is possible to improve the matching of the hydraulic pressure.

Next, other embodiments according to the present invention are explained. In the below-described explanations, the repetitive explanations are omitted by providing the same symbols to the identical constituting elements in the above-described first embodiment.

FIG. 7 to FIG. 12 show a second embodiment according to the present invention. The second embodiment has the structure substantially identical to that of the first embodiment. However, in this second embodiment, the bypass passage 18 is formed between the oil cooler mounting surface 8 of the cylinder block 3, and the bottom surface of the oil cooler 61. Furthermore, the bypass valve 62 is mounted in the upstream hole portion 27 of the cylinder block 3. Besides, in FIG. 7 and FIG. 8, the hatchings of the section of some members are omitted.

Figure 9:
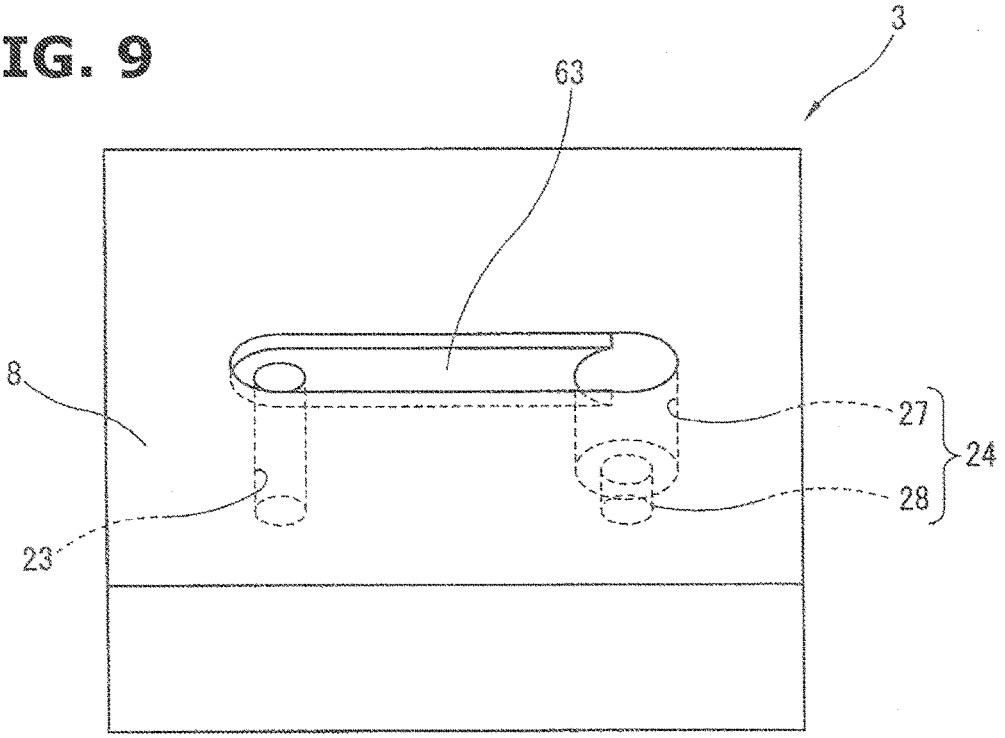
FIG. 9 is a schematic view showing a mounting surface of a cylinder block on which an oil cooler is mounted in the oil bypass structure of the oil cooler according to the second embodiment.

In this second embodiment, a grove portion 63 is formed on the oil cooler mounting surface 8 of the cylinder block 3, as shown in FIG. 9. This groove portion 63 has a thin elongated shape having a constant depth. A block side oil introduction passage 23 is opened on a bottom surface of one end side of this groove portion 63. The upstream side hole portion 27 is opened on the bottom surface of the other end side of this groove portion 63. This groove portion 63 and the bottom plate 64 mounted on the lowermost surface of the heat exchange section 4 constitute the bypass passage 18 within which the oil bypasses the heat exchange section 4 for the explanations.

The oil cooler 61 according to the second embodiment is constituted from the heat exchange section 4, the top plate 5, and the bottom plate 64. The first bottom plate 6 in the first embodiment is omitted.

In the oil cooler 61 according to the second embodiment, the bottom plate 64 includes the oil inlet side through hole 65 which has a circular section, and within which the oil introduced into the oil flow passage 11 within the heat exchange section 4 flows; and the oil outlet side through hole 66 which has a circular section, and within which the oil discharged from the oil flow passage 11 within the heat exchange section 4 flows. The oil inlet side through hole 65 includes a lower end connected through the one end side of the groove portion 63 to the block side oil introduction passage 23 formed in the cylinder block 3; and an upper end connected to the oil introduction opening 16 formed on the lowermost surface of the heat exchange section 4. The oil outlet side through hole 66 includes a lower end connected through the other end side of the groove portion 63 to the block side oil discharge passage 24 formed in the cylinder block 3; and an upper end connected to the oil discharge opening 17 formed on the lowermost surface of the heat exchange section 4.

Figure 7:
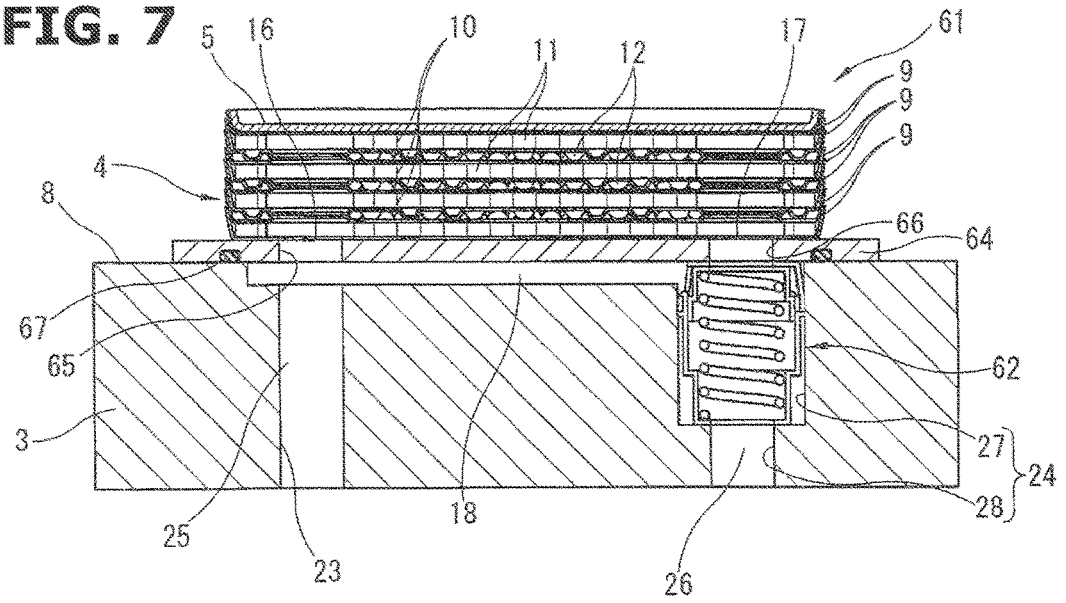
FIG. 7 is a sectional view which is for illustrating an oil bypass structure of an oil cooler according to a second embodiment of the present invention, and which shows main parts in a valve closing state of a bypass valve.
Figure 8:
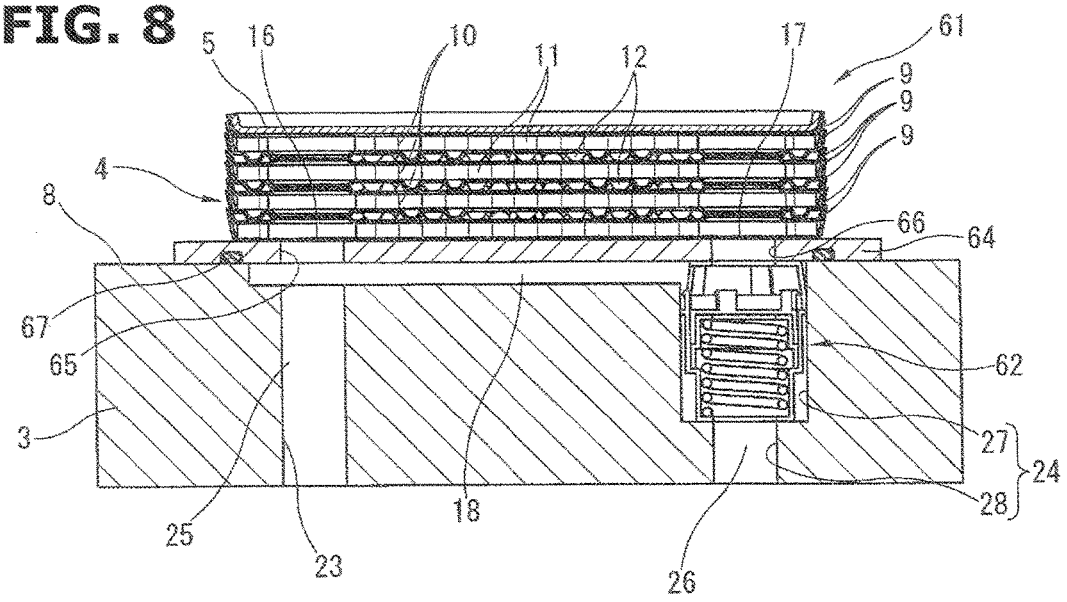
FIG. 8 is a sectional view which is for illustrating the oil bypass structure of the oil cooler according to the second embodiment of the present invention, and which shows main parts in a valve opening state of the bypass valve.

Moreover, this bottom plate 64 includes a coolant inlet side through hole (not shown) within which the coolant introduced into the coolant flow passage 12 within the heat exchange section 4 flows; and a coolant outlet side through hole (not shown) through which the coolant discharged from the coolant flow passage 12 within the heat exchange section 4 flows. The coolant inlet side through hole is connected to a block side coolant introduction passage (not shown) formed in the cylinder block 3. The coolant inlet side through hole is connected to a block side coolant discharge passage (not shown) formed in the cylinder block 3. Besides, a symbol 67 in FIG. 7 and FIG. 8 is a seal member arranged to seal a portion around the groove portion 63 on the oil cooler mounting surface 8.

Figure 10:
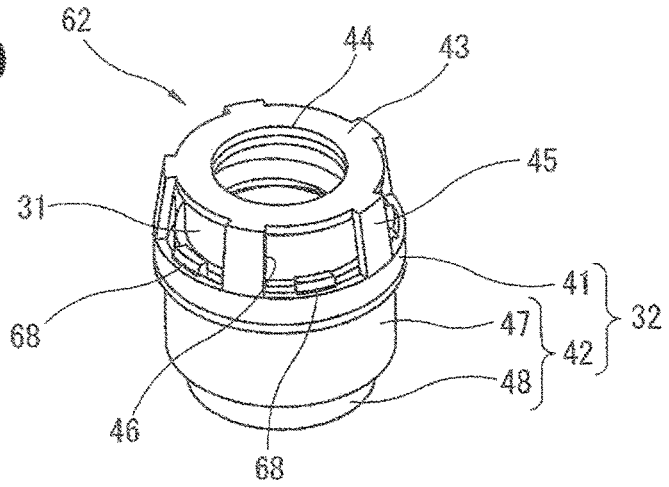
FIG. 10 is a perspective view showing the bypass valve according to the second embodiment.
Figure 11:
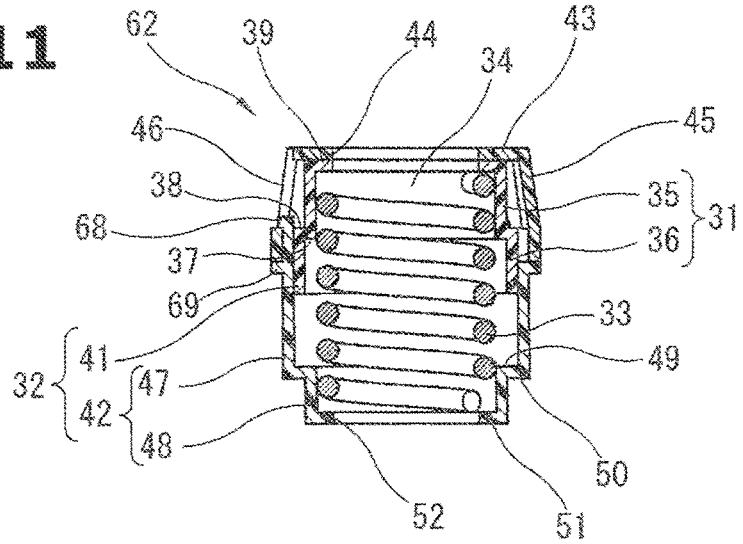
FIG. 11 is a sectional view showing the bypass valve according to the second embodiment.
Figure 12:
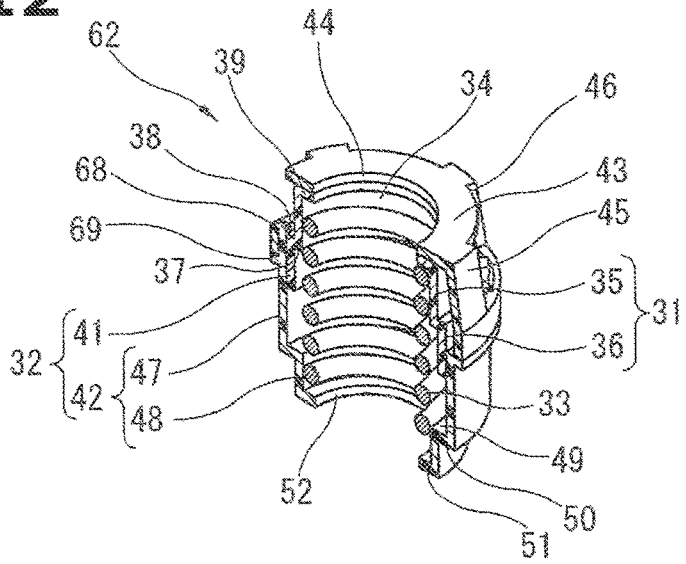
FIG. 12 is an explanation view showing the bypass valve whose a part is cut away in the second embodiment.

As shown in FIG. 10 to FIG. 12, the bypass valve 62 in the second embodiment has a structure substantially identical to that of the first embodiment. The large diameter portion 47 of the lower casing 42 is inserted into the inner circumference side of the upper casing 41. That is, the upper end side of the large diameter portion 47 of the lower portion casing 42 is inserted into the lower end side of the upper casing 41. The protrusions 68 and 69 of the outer circumference of the upper end of the large diameter portion 47 of the lower casing 42 are engaged with the side opening portion 46 of the upper casing 41 and the lower end of the upper casing 41. With these, the upper casing 41 and the lower casing 42 are fixed with each other. That is, in the bypass valve 62 according to the second embodiment, the upper casing 41 and the lower casing 42 are connected by the snap fit, like the first embodiment.

Moreover, the valve element 31 is received within the large diameter portion 47 of the lower casing 42. The large diameter portion 47 of the lower casing 42 has an inside diameter set so that the lower end portion 36 of the valve element 31 can be slid within the large diameter portion 47 of the lower casing 42.

The bypass valve 62 is mounted in the upstream side hole portion 27 of the block side oil discharge passage 24 of the cylinder block 3, for example, by the press-fit. In this case, the upstream side of the bypass valve 62 is disposed within the bypass passage 18. That is, in this second embodiment, like the first embodiment, the bypass valve 21 is disposed at the connection portion between the outlet side passage 26 and the bypass passage 18. Moreover, the bypass passage 18 is connected to the bypass valve 62 from the direction perpendicular to the axial direction of the valve element 31.

Besides, in this second embodiment, the upper end of the bypass valve 62 is closely abutted on the bottom plate 64 in a state where the oil cooler 61 is mounted to the cylinder block 3.

In this second embodiment, the bypass passage 18 is formed between the bottom surface of the oil cooler 61 and the oil cooler mounting surface 8 of the cylinder block 3. Accordingly, it is possible to simplify the structure of the oil cooler 61. Moreover, it is possible to form the bypass passage 18 in the cylinder block 3 in the relatively easier manner, relative to the case where the bypass passage 18 is formed within the cylinder block 3.

Furthermore, in this oil bypass structure according to the second embodiment, the valve element 31 of the bypass valve 62 includes the inside passage 34 which is formed inside the valve element 31, and within which the oil flows. Moreover, the bypass passage 18 is connected to the bypass valve 62 from the direction perpendicular to the axial direction of the valve element 31. Accordingly, it is possible to suppress the size of the system, and to omit the oil passage which is located on the downstream side of the bypass valve 62, and through the only oil passing through the bypass passage 18 flows. Consequently, it is possible to relatively simplify the oil bypass structure of the oil cooler 61, and to attain the cost reduction. Furthermore, it is possible to improve the freedom of the layout.

Moreover, in the bypass valve 62, the clearance between the valve element 31 and the large diameter portion 47 of the lower casing 42 may be set to a large size. With this, the matching of the hydraulic pressure is improved by using the bypass passage 18 even when the valve element 31 is closed (the valve element 31 is pressed on the bottom wall 43 of the upper casing 41).

FIG. 13 to FIG. 17 show a third embodiment according to the present invention. The third embodiment has a structure substantially identical to that of the first embodiment. However, in the bypass valve 72 according to the third embodiment, the upper casing 41 of the bypass valve 2 according to the first embodiment is omitted.

Figure 15:
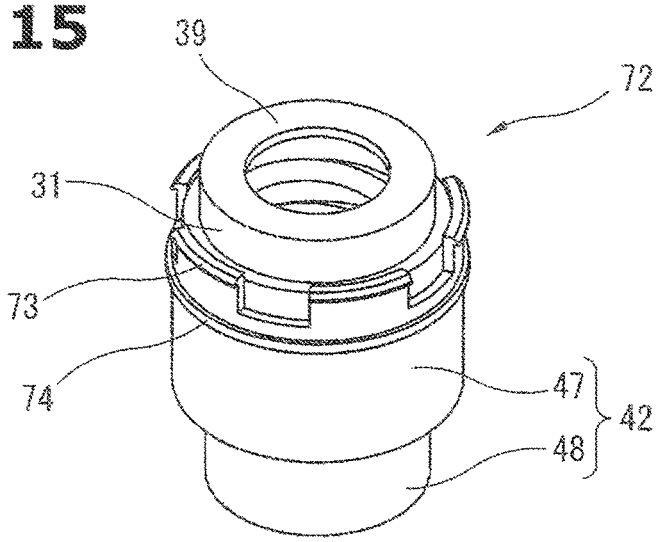
FIG. 15 is a perspective view showing the bypass valve according to a third embodiment.
Figure 16:
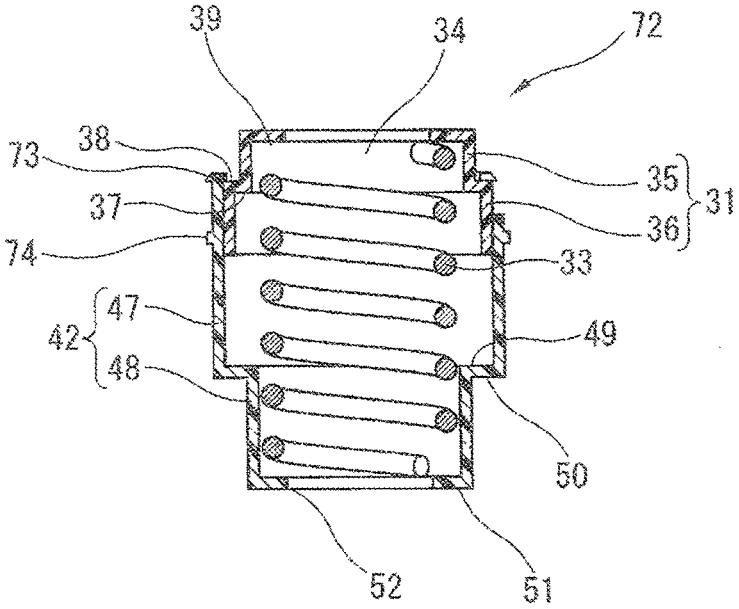
FIG. 16 is a sectional view showing the bypass valve according to the third embodiment.
Figure 17:
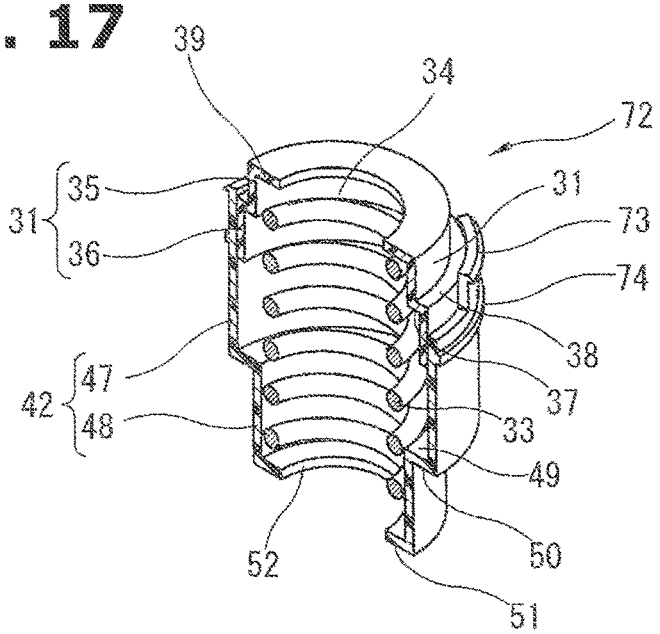
FIG. 17 is an explanation view showing the bypass valve whose a part is cut away in the second embodiment.

That is, in the bypass valve 72 according to the third embodiment, the valve element 31 and the coil spring 33 are received within the casing 42 having the stepped bottomed cylindrical casing 42, as shown in FIG. 15 to FIG. 17. In the valve closing state, the valve element 31 is directly pressed on the lowermost surface of the heat exchange section 4.

In this third embodiment, the protrusions 73 and 74 formed on the outer circumference side of the upper end of the casing 42 are engaged, respectively, with the upper opening edge and the lower opening edge of the second oil outlet side through hole 22, so that it is fixed to the oil cooler 1.

Figure 13:
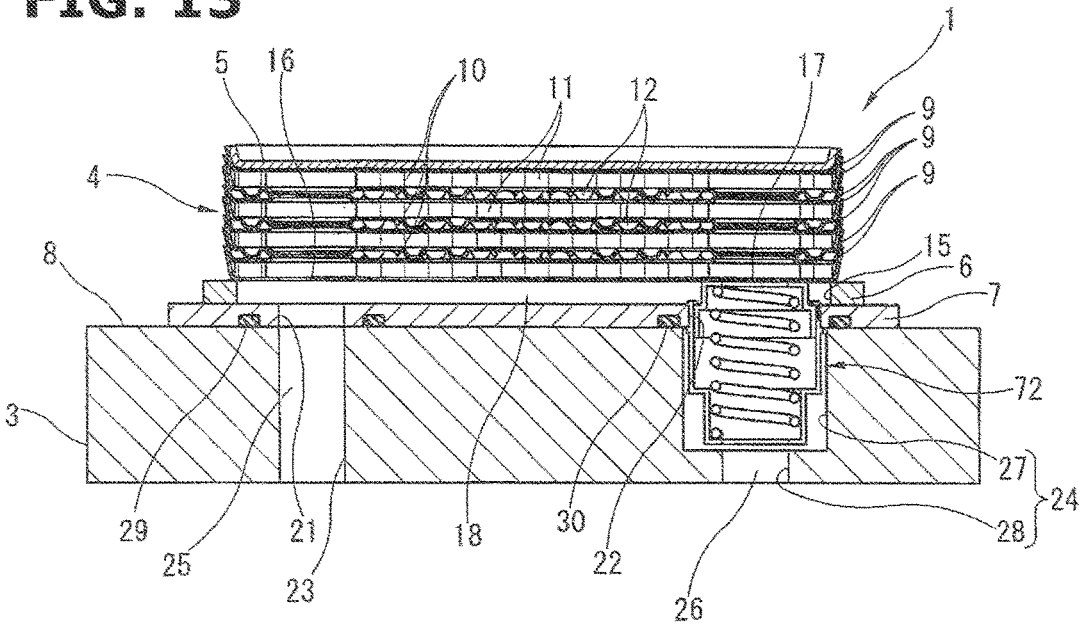
FIG. 13 is a sectional view which is for illustrating an oil bypass structure of an oil cooler according to a third embodiment of the present invention, and which shows main parts in a valve closing state of a bypass valve.
Figure 14:
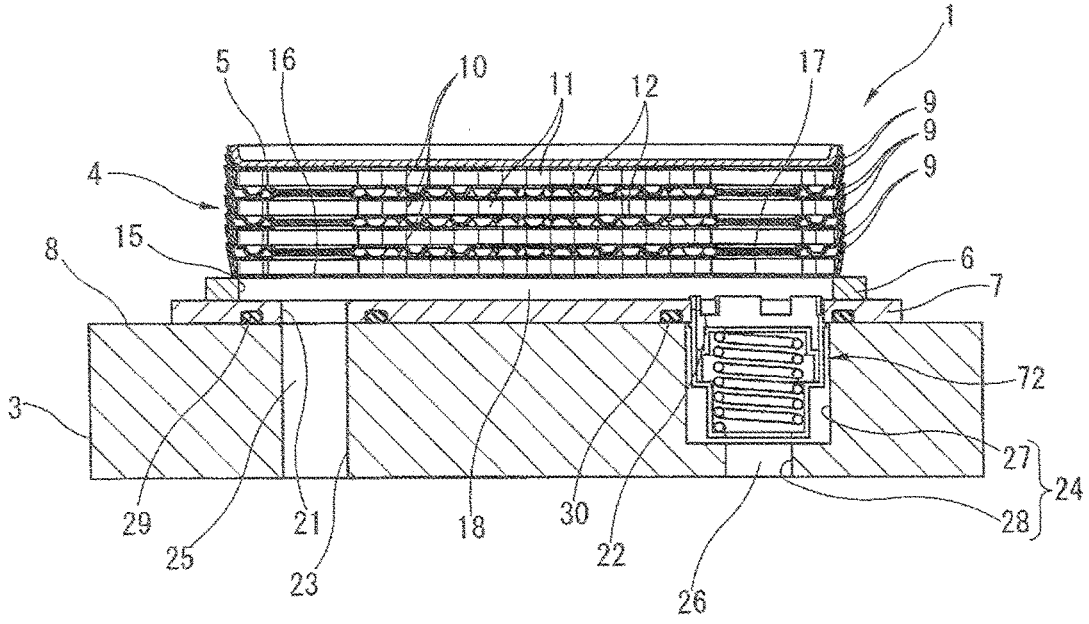
FIG. 14 is a sectional view which is for illustrating the oil bypass structure of the oil cooler according to the third embodiment of the present invention, and which shows main parts in a valve opening state of the bypass valve.

Besides, in FIG. 13 and FIG. 14, the hatchings of the section of a part of the members are omitted for the explanations.

In this third embodiment, it is possible to attain the effects and the operations identical to those of the first embodiment.

Moreover, in this third embodiment, it is possible to relatively decrease the number of the components of the bypass valve 72.

According to the above-described embodiments, an oil bypass structure of an oil cooler includes: a bypass passage within which an oil bypassing a heat exchange section of the oil cooler flows; an outlet side passage within which the oil passing through the heat exchange section flows; and a bypass valve disposed at a connection portion between the bypass passage and the outlet side passage, the bypass valve which includes a valve element including an inside passage which is formed within the valve element, and within which the oil flows, the bypass valve to which the bypass passage is connected from a direction perpendicular to an axial direction of the valve element, the bypass valve being arranged to be closed to shut off a flow of the oil from the bypass passage to the outlet side passage by the valve element so that the oil passing through the heat exchange section flows within the inside passage, and to be opened to connect the bypass passage and the inside passage so that the oil passing through the bypass passage flows within the inside passage.

The bypass passage is formed within the oil cooler; and the bypass valve is fixed to the oil cooler.

The bypass passage is formed between a bottom surface of the oil cooler, and a mounting surface of a block on which the oil cooler is mounted; and the bypass valve is fixed to the block.

The bypass valve includes a spring member arranged to constantly urge the valve element in a valve closing direction; the valve element includes a pressure receiving surface which is formed on an outer circumference of the valve element, and which is arranged to receive a force in a valve opening direction from the oil within the bypass passage; and the valve element is arranged to be moved in the valve opening direction to connect the inside passage and the bypass passage when the pressure of the oil flowing within the inside passage is decreased, and when the pressure of the oil acted on the pressure receiving surface becomes greater than the urging force of the spring member.

By the above-described structures, the oil introduced through the bypass passage into the outlet side passage, and the oil introduced through the oil cooler into the outlet side passage without passing through the bypass passage flow within the valve element flow within the valve element. Accordingly, it is not necessary to provide an oil passage which is located on the downstream side of the bypass valve, and through which the only oil passing through the bypass passage flows. Accordingly, it is possible to relatively simplify the oil bypass structure of the oil cooler, and to improve the freedom of the layout. Consequently, it is possible to decrease the cost.

Moreover, the bypass valve is fixed to the oil cooler so that the bypass valve and the oil cooler are integrated. In this case, it is possible to improve the assembly characteristics of the oil cooler. In a case where the bypass valve is formed within the oil cooler, it is possible to simplify the processing process in which the oil cooler is mounted to the mounted side, relative to a case where the bypass passage is formed in the mounted side of the oil cooler. Accordingly, it is possible to decrease the cost.

Furthermore, in a case where the bypass valve is formed on the mounting surface of the block on which the oil cooler is mounted, it is possible to relatively easily form the bypass valve on the block.

The entire contents of Japanese Patent Application No. 2015-249483 filed Dec. 22, 2015 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An oil bypass structure of an oil cooler comprising:

a bypass passage within which oil bypassing a heat exchange section of the oil cooler flows;

an outlet side passage within which oil passing through the heat exchange section flows; and a bypass valve disposed at a connection portion between the bypass passage and the outlet side passage, the bypass valve including a valve element including an inside passage which is formed within the valve element, and within which the oil flows, the bypass passage being connected to the bypass valve from a direction perpendicular to an axial direction of the valve element, the bypass valve being arranged to be closed to shut off a flow of the oil from the bypass passage to the outlet side passage by the valve element such that the oil passing through the heat exchange section flows within the inside passage, and to be opened to connect the bypass passage and the inside passage such that the oil passing through the bypass passage flows within the inside passage, wherein the bypass valve includes a coil spring arranged to constantly urge the valve element in a valve closing direction;

the valve element includes a pressure receiving surface which is formed on an outer circumference of the valve element, and which is arranged to receive a force in a valve opening direction from the oil within the bypass passage; and the valve element is arranged to be moved in the valve opening direction to connect the inside passage and the bypass passage when the pressure of the oil flowing within the inside passage is decreased, and when the pressure of the oil acting on the pressure receiving surface becomes greater than an urging force of the coil spring.

2. The oil bypass structure of the oil cooler as claimed in claim 1, wherein the bypass passage is formed within the oil cooler; and the bypass valve is fixed to the oil cooler.

3. The oil bypass structure of the oil cooler as claimed in claim 1, wherein the bypass passage is formed between a bottom surface of the oil cooler and a mounting surface of a block on which the oil cooler is mounted; and the bypass valve is fixed to the block.

4. An oil bypass structure of an oil cooler comprising:

a bypass passage within which oil bypassing a heat exchange section of the oil cooler flows;

an outlet side passage within which oil passing through the heat exchange section flows; and a bypass valve disposed at a connection portion between the bypass passage and the outlet side passage, the bypass valve including a valve element including an inside passage which is formed within the valve element, and within which the oil flows, the bypass passage being connected to the bypass valve from a direction perpendicular to an axial direction of the valve element, the bypass valve being arranged to be closed to shut off a flow of the oil from the bypass passage to the outlet side passage by the valve element such that the oil passing through the heat exchange section flows within the inside passage, and to be opened to connect the bypass passage and the inside passage such that the oil passing through the bypass passage flows within the inside passage, wherein the bypass valve includes a spring arranged to constantly urge the valve element in a valve closing direction;

the valve element includes a pressure receiving surface which is formed on an outer circumference of the valve element, and which is arranged to receive a force in a valve opening direction from the oil within the bypass passage; and the valve element is arranged to be moved in the valve opening direction to connect the inside passage and the bypass passage when the pressure of the oil flowing within the inside passage is decreased, and when the pressure of the oil acting on the pressure receiving surface becomes greater than an urging force of the spring.

* * * * *